US007243480B2

(12) United States Patent
Schäfer

(10) Patent No.: US 7,243,480 B2
(45) Date of Patent: Jul. 17, 2007

(54) WAFER FIXING AND MARKING

(75) Inventor: Wolfgang Schäfer, Madison, NJ (US)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 10/565,579

(22) PCT Filed: Jul. 14, 2004

(86) PCT No.: PCT/EP2004/007749

§ 371 (c)(1),
(2), (4) Date: Jan. 23, 2006

(87) PCT Pub. No.: WO2005/012097

PCT Pub. Date: Feb. 10, 2005

(65) Prior Publication Data

US 2006/0288662 A1 Dec. 28, 2006

(51) Int. Cl.
*B65B 9/02* (2006.01)
*B65B 61/00* (2006.01)

(52) U.S. Cl. ..... 53/450; 53/411; 53/131.1; 53/553

(58) Field of Classification Search ..... 53/450, 53/411, 440, 449, 553, 131.1, 127, 174
See application file for complete search history.

(56) References Cited

U.S. PATENT DOCUMENTS

RE21,065 E * 5/1939 Copeman ..... 206/338
2,737,764 A * 3/1956 Clyde ..... 53/433
2,895,270 A * 7/1959 Blaess ..... 53/411
3,496,910 A * 2/1970 Nugarus ..... 118/603
3,575,755 A * 4/1971 Cutler et al. ..... 156/85
3,733,768 A * 5/1973 Carls et al. ..... 53/411
6,165,499 A * 12/2000 Kleinsorgen et al. ..... 424/449
6,182,420 B1 * 2/2001 Berman et al. ..... 53/431
6,467,621 B1 10/2002 Ishida

FOREIGN PATENT DOCUMENTS

| | | |
|---|---|---|
| CA | 2317491 | 1/1999 |
| DE | 101 44 287 A1 | 4/2003 |
| WO | WO 99/35051 | 7/1999 |
| WO | WO 2064123 A2 * | 8/2002 |

* cited by examiner

*Primary Examiner*—Stephen F. Gerrity
(74) *Attorney, Agent, or Firm*—Frommer Lawrence & Haug LLP

(57) ABSTRACT

The invention relates to a method for individually packing sheet or film-type materials in an automatic manner, said materials consisting of at least one material layer, in a packing unit with marked contents. A marking (40) made of a waxy marking material is applied to a warmed first packing material strip (20). The sheet or film-type material (10) is fixed to the marking wit surface thereof, whereby the roughness of the surface thereof is greater than the roughness of the surface of the first packing material strip. A second packing material strip (30) is applied to the sheet or film-type material and is connected to the first packing material strip in order to form a closed packing unit. The packing unit (35) is cooled and the marking is separated from the first packing material strip. A secure packing method and a marking for sheet or film-type materials are developed according to said inventive method.

5 Claims, 1 Drawing Sheet

WAFER FIXING AND MARKING

Figure 1:
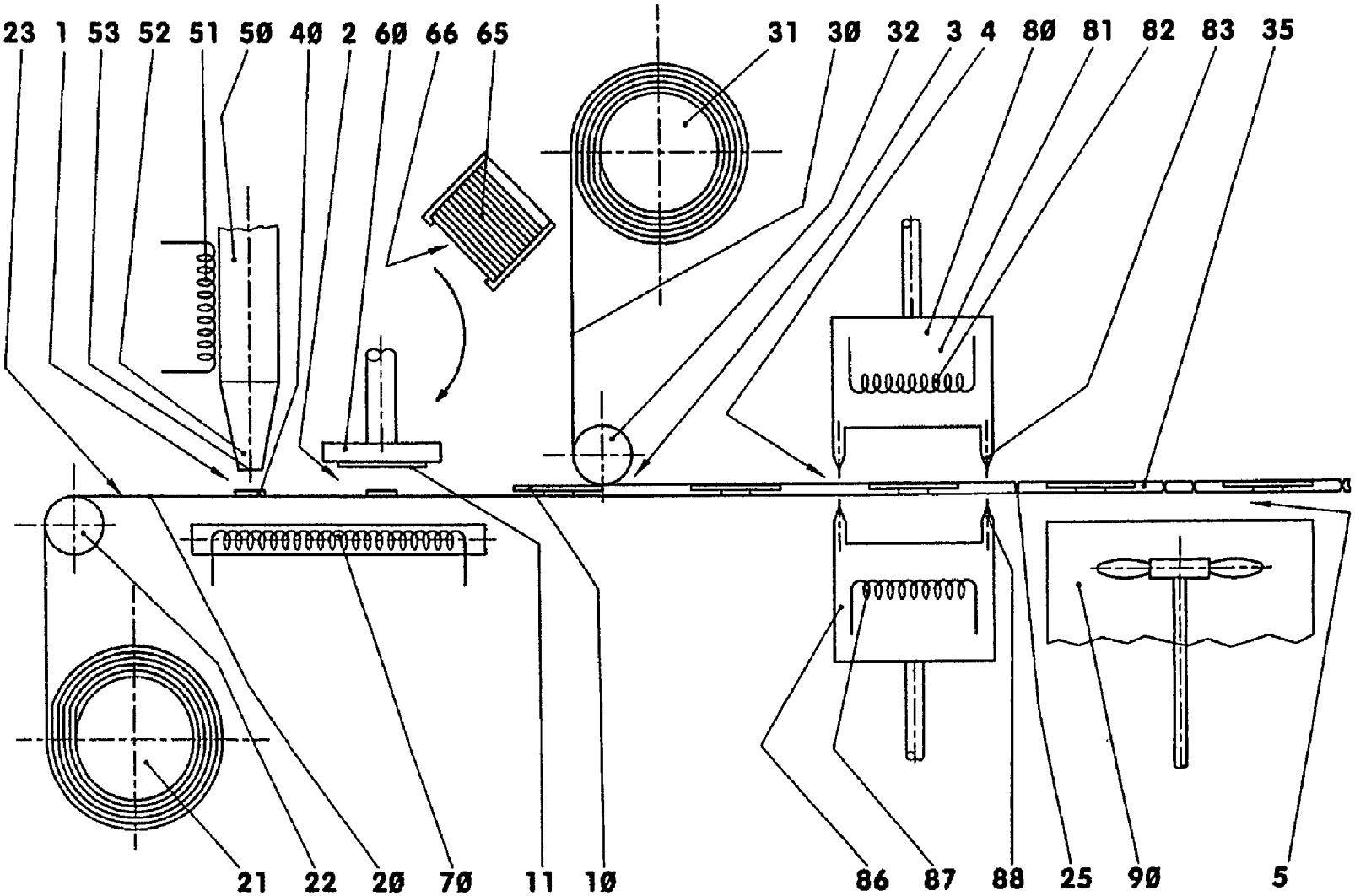

The invention relates to a method for individually packing sheet- or film-like materials in an automatic manner, said materials consisting of at least one material layer, in a packing unit with marked contents.

Sheet- or film-like materials are used for example in pharmacy as carriers of active pharmaceutical substances. The materials are, for example, thin, lightweight and flexible films of modified starch. They are constructed with one or more layers, at least one layer receiving the active substance. These sheet- or film-like materials are, for example, water-soluble. When they are applied to a person, for example on the tongue, they dissolve and release the active substance.

To avoid drying out, these sheet- and film-like materials are generally individually packed. For packing, a single sheet- or film-like material is inserted between two packing material strips and the packing material strips are welded to each other, for example to form a four-edge sealed bag. During insertion of the single sheet- or film-like material between the packing material strips, a slight draft of air is already enough to change the position of the material or blow it away from the area of the packing material strips. Only once the single four-edge sealed bag has been sealed, for example, can it be established whether there is in fact a sheet- or film-like material in the four-edge sealed bag.

As carriers of pharmaceutical products, the sheet- or film-like materials have to be marked. Such a marking serves for example to identify the type, batch and/or the single sheet- or film-like material. When the marking is applied, the sheet- or film-like material must not be attacked. A water-soluble or solvent-containing marking therefore cannot be considered, since the concentration of the active substance in the sheet- or film-like material would be changed by the water or the solvent.

The present invention is based on the problem of developing an operationally reliable automated packing and marking method for sheet- or film-like materials.

This problem is solved by the features of the main claim. For this purpose, a marking made of a waxy marking material is applied to a heated first packing material strip. The sheet- or film-like material is fixed on the marking with a surface of a roughness greater than the roughness of the surface of the first packing material strip, on which the marking is adhesively attached. A second packing material strip is placed over the sheet- or film-like material and joined to the first packing material strip to form a closed packing unit. The packing unit is cooled, the marking coming away from the first packing material strip.

Waxy materials are organic substances. At a room temperature of 20° C., for example, they are tough to hard. With increasing temperatures, they become plastically deformable. At temperatures above 40° C., for example, they are meltable, the viscosity of the melt decreasing with increasing temperature. Waxy materials are, for example, naturally occurring animal or vegetable waxes, such as for example beeswax, and synthetic waxes, for example mixtures of solid paraffins.

When the marking made of a waxy material is applied, liquid, viscous or solid wax is applied to the heated first packing material strip. Application takes place, for example, by spraying from a fixed or movable nozzle with or without a template, by a wax crayon, etc. When a liquid wax is applied, the mentioned first packing material strip prevents the wax from hardening. If a solid wax is applied, it is heated at least into the viscous state by the heated packing material strip.

The surface of the packing material strip has a low roughness. Therefore, the wax adheres with low affinity to the packing material strip.

To fix the sheet- or film-like material on the marking, the sheet- or film-like material is placed onto the marking with a rough surface. The two parts adhere to each other with high affinity. For example, a draft of air cannot change the position of the sheet- or film-like material in relation to the packing material strip.

In the next method step, the second packing material strip is placed over the sheet- or film-like material and the two packing material strips are welded, for example by means of a sealing-edge welding. The sheet- or film-like material is further fixed on the marking, which adheres to the first packing material strip.

The packing unit produced in this way is then cooled. As this happens, the wax hardens. It comes away from the surface of the first packing material strip, but continues to adhere to the surface of the sheet- or film-like material. As a result, the marking is transferred to the sheet- or film-like material.

After completion of the method, each packing unit contains a uniformly positioned, marked sheet- or film-like material.

These method steps consequently make automated packing and marking of sheet- or film-like materials possible.

Further details of the invention emerge from the subclaims and the following description of a schematically represented embodiment.

FIG. 1 shows a method for packing and marking sheet- or film-like materials.

FIG. 1 shows a method for packing and marking sheet- or film-like materials (10). The sheet- or film-like materials (10) are, for example, wafers (10). These are water-soluble, thin films of modified starch which contain an active pharmaceutical substance. The dimensions of a wafer (10) are, for example, approximately 20×30 mm.

The method comprises, for example, five steps (1-5). In a first method step (1), a marking (40) is applied to a first, lower packing material strip (20), for example by means of a spray unit (50).

In the second method step (2), the wafer (10), which is conveyed for example by means of a suction gripper (60) from a magazine (65) onto the first packing material strip (20), is placed onto the marking (40). The first packing material strip (20) is heated, for example to approximately 40° C., during the application of the marking (40) and the placement of the wafer (10), for example by means of a heater (70).

In the next method step (3), a second, for example upper, packing material strip is placed onto the wafer (10) and the lower packing material strip (20).

In the fourth method step (4), the two packing material strips (20, 30) lying one on top of the other are joined by a sealing device (80), for example with four sealing seams (25). In this way, a four-edge sealed bag (35), which is closed on all sides and in which precisely one wafer (10) is packed, is produced for example as a packing unit (35).

In the next method step (5), the four-edge sealed bags (35) are cooled by means of a cooling unit (90), for example from their underside.

The lower packing material strip (20) is, for example, a transparent strip of plastic film, for example made of polyethylene. At least the upper surface (23) of this packing material strip has a low roughness; it is therefore largely smooth. If appropriate, it may also be coated with silicone.

The lower packing material strip (20) is unwound from a drum (21) and passed over a deflecting roller (22). The packing material strip (20) is aligned and tensioned, for example by a radial adjustment of the deflecting roller (22).

In the first method step (1), the marking (40) is applied to the upper surface (23) of the packing material strip (20) heated by means of a heater (70). The marking (40) is made of a wax-like material, for example beeswax. It may be transparent or colored.

Before application, for example in the spray unit (50), the beeswax is heated to a temperature, for example of 80° C., by a heater (51). At this temperature, it is liquid and has a low viscosity. For example inside the spray unit (50), the beeswax is conveyed to a spray head (52). The spray head (52) comprises, for example, a template and a nozzle (53), through which the beeswax is directed onto the packing material strip (20). As this happens, there forms, for example, the image of the template on the packing material strip (20). The beeswax applied as a marking (40) may be monochrome or multicolored. The marking (40) may comprise, for example, a sequence of alphanumeric, digital or color-coded characters or symbols.

The spray head (52) and/or the nozzle (53) may be fixed or movable. A movable spray head (52) and/or a movable nozzle (53) may, for example, be activated in a computer-aided manner, so that for example each single wafer (10) receives an individual marking (40). If a movable spray head (52) and/or a movable nozzle (53) is used, it is possible for example to dispense with a template.

The spray unit (50) may comprise a number of spray heads (52) and/or nozzles. These may be fixed or movable. A cleaning device may also be arranged on or in the spray unit (40), for example for cleaning the nozzle (53).

When the hot beeswax impinges on the surface (23) of the mentioned packing material strip (20), the beeswax is cooled. Since, however, the temperature of the packing material strip (20) is higher than the solidifying temperature of the beeswax, it remains viscous. It adheres to the at least largely smooth surface (23) of the packing material strip (20). The marking (40) is then readable, for example, from the underside of the packing material strip (20).

Once the marking (40) has been applied, the heated packing material strip (20) is conveyed further for the loading (2) with the single wafer (10). The packing material strip (20) may also be heated by the heater (70) during the loading (2).

The single wafer (10) has at least one surface (11) of a roughness which is greater than the roughness of the surface (23) of the packing material strip (20). In the magazine (65), the wafers (10) are, for example, stacked in such a way that these rough surfaces (11) are facing away from the removal side (66) of the magazine (65).

For the removal of the wafer (10) from the magazine (65), for example, the suction gripper (60) is positioned in front of the magazine (65). By switching on the negative pressure, the first wafer (10) lying in the magazine (65) is sucked and picked up. The suction gripper (60) then pivots, for example into a position above the packing material strip (20), and moves axially in the direction of the packing material strip (20). As soon as the wafer (10) touches the marking (40), the negative pressure is switched off. The wafer (10) comes away from the suction gripper (60) and adheres with the rough surface (11) on the marking (40).

The loaded packing material strip (20) is then conveyed further in a clocked manner for the application (3) of the upper packing material strip (30).

The upper packing material strip (30) may consist of the same material as the lower packing material strip (20). It runs off from a drum (31). The upper packing material strip (30) is aligned and tensioned, for example by means of a deflecting roller (32). The two packing material strips (20, 30) are conveyed, for example, by a common drive. They are then moved with an identical clock frequency and the same clock increment.

In the next clock cycle, the clock frequency is, for example, 100 cycles per minute; the packing material strips (20, 30) with the wafer (10) are conveyed under the sealing unit (80) for sealing (4).

The sealing unit (80) comprises, for example, an upper sealing unit part (81) and a lower sealing unit part (86). Both parts (81, 86) comprise, for example, sealing heaters (82, 87), with which sealing bars (83, 88) are heated. In FIG. 1, only two sealing bars (83, 88) per sealing unit part (81, 86) are represented, for sealing seams (25) oriented transversely in relation to the conveying direction. It goes without saying that additional sealing bars may also be provided, for example for sealing seams in the conveying direction. For sealing (4), the sealing unit parts (81, 86) are moved toward one another and thereby weld the packing material strips (20, 30) lying between them to one another. In this process, the welding duration is, for example, 1/160 of a second. So, for example, four sealing seams (25) are produced around the wafer (10). The wafer (10) is then packed in a packing unit (35), for example a four-edge sealed bag (35). The single packing units (35) are joined to one another and are further conveyed together for cooling (5).

In the cooling (5), the four-edge sealed bags (35) are cooled, for example to a room temperature of 20° C., by means of the cooling unit (90), arranged for example underneath the conveyed material (20, 30, 35). The beeswax then solidifies completely. It comes away from the surface (23) of the lower packing material strip (20). However, it continues to remain adhesively attached to the rougher surface (11) of the wafer (10). The marking (40) is in this way transferred to the wafer (10).

In the case of this method, the substance of the wafer (10) is not changed. The wafer (10) retains its concentration of active substance and its moisture content.

LIST OF DESIGNATIONS

1 first method step, marking
2 second method step, loading
3 third method step, applying the upper packing material strip
4 fourth method step, sealing
5 fifth method step, cooling
10 sheet- or film-like material, wafer
11 surface
20 first packing material strip, lower packing material strip
21 drum
22 deflecting roller
23 surface
25 sealing seams
30 second packing material strip, upper packing material strip
31 drum
32 deflecting roller
35 packing unit, four-edge sealed bag
40 marking
50 spray unit
51 heater
52 spray head

53 nozzle
60 suction gripper
65 magazine
66 removal side
70 heater
80 sealing unit
81 upper sealing unit part
82 sealing heater
83 sealing bars
86 lower sealing unit part
87 sealing heater
88 sealing bars
90 cooling unit

The invention claimed is:

1. A method for individually packing sheet- or film-like materials in an automatic manner, said materials consisting of at least one material layer, in a packing unit with marked contents, a marking (40) made of a waxy marking material being applied to a heated first packing material strip (20), the sheet- or film-like material (10) being fixed on the marking (40) with a surface (11) of a roughness greater than the roughness of the surface (23) of the first packing material strip (20), on which the marking is adhesively attached, a second packing material strip (30) being placed over the sheet- or film-like material (10) and joined to the first packing material strip (20) to form a closed packing unit (35), the packing unit (35) being cooled and the marking (40) thereby coming away from the first packing material strip (20).

2. The method as claimed in claim 1, characterized in that the first packing material strip (20) is heated during the application of the marking (40) and the fixing of the sheet- or film-like material (10).

3. The method as claimed in claim 1, characterized in that the marking material is a beeswax.

4. The method as claimed in claim 1, characterized in that the sheet- or film-like materials (10) are water-soluble.

5. The method as claimed in claim 1, characterized in that the sheet- or film-like materials (10) are packed in a four-edge sealed bag (35).

* * * * *